US006570480B1

(12) United States Patent
Huang

(10) Patent No.: US 6,570,480 B1
(45) Date of Patent: May 27, 2003

(54) CIRCUIT BREAKER

(76) Inventor: Albert Huang, 3F, No. 146, Sec. 4, Chungking S. Rd., Taipei (TW)

( * ) Notice: Subject to any disclaimer, the term of this patent is extended or adjusted under 35 U.S.C. 154(b) by 0 days.

(21) Appl. No.: 10/037,252

(22) Filed: Jan. 2, 2002

(51) Int. Cl.[7] ..... H01H 71/04; H01H 71/54

(52) U.S. Cl. ..... 337/79; 337/376; 337/59; 116/279; 116/307

(58) Field of Search ..... 337/37, 59, 66, 337/79, 376; 29/622; 116/202, 279, 307

(56) References Cited

U.S. PATENT DOCUMENTS 2,496,759 A * 2/1950 Warsher ..... 337/76
3,435,169 A * 3/1969 Bienwald et al. ..... 200/315
3,735,077 A * 5/1973 Ohashi ..... 200/315
4,075,449 A * 2/1978 Yagi et al. ..... 200/315
4,337,450 A * 6/1982 Matthies ..... 337/66
4,345,233 A * 8/1982 Matthies ..... 337/75
4,672,351 A * 6/1987 Cheng ..... 337/123
4,778,967 A * 10/1988 Deng ..... 200/315
5,012,495 A * 4/1991 Munroe et al. ..... 337/3
5,089,799 A * 2/1992 Sorenson ..... 337/68
5,491,460 A * 2/1996 Krasser et al. ..... 337/70
5,541,569 A * 7/1996 Jang ..... 337/68
5,694,106 A * 12/1997 Wang ..... 337/79
5,760,672 A * 6/1998 Wang ..... 337/79
5,889,457 A * 3/1999 Hsu et al. ..... 337/59
6,252,490 B1 * 6/2001 Lin ..... 337/79
6,275,134 B1 * 8/2001 Chen ..... 337/37
6,448,880 B2 * 9/2002 Yu ..... 337/66

FOREIGN PATENT DOCUMENTS

GB 2177543 A * 1/1987 ..... H01H/73/30

* cited by examiner

*Primary Examiner*—Anatoly Vortman
(74) *Attorney, Agent, or Firm*—Dellett and Walters

(57) ABSTRACT

A circuit breaker includes a shell with a hollow button at the top. The button has an indicator light received therein and a central tab extending downward. A first blade, a second blade and a grounding prong extend out of the shell through the bottom of the shell. A curved metal piece is housed in the shell and electrically and pivotally connected to an inner end of the second blade. A helical spring is mounted around the tab and compressed between the hollow button and the curved metal piece, and additionally a resistor is held in the shell and electrically connected to the grounding prong. The indicator light has a first terminal electrically connected with the helical spring and a second terminal selectively engaged with the resistor.

3 Claims, 4 Drawing Sheets

CIRCUIT BREAKER

BACKGROUND OF THE INVENTION

1. Field of the Invention

The present invention relates to a circuit breaker and, more particularly, to a circuit breaker which has a prolonged life.

2. Description of Related Art

Many circuit breakers are known. FIG. 4 shows one which includes a shell (40) having an open top and a closed bottom, with a hollow button (50) pivotally connected to the shell (40) at the open top, and a first blade (41), a second blade (42) and a grounding prong (43) extending out of the shell (40) through the closed bottom.

The first blade (41) has an inner end formed with a first contact (411), and the second blade (42) has an inner end pivotally connected to a curved metal piece (60) which is formed with a second contact (61) of platinum. A helical spring (54) is compressed between the hollow button (50) and the curved metal piece (60).

Furthermore, the hollow button (50) receives an indicator light (51) having a first terminal (52) and a second terminal (53). The first terminal (52) is electrically connected with the helical spring (54), while the second one (53) is engagable with the ground prong (43).

Normally, the blades (41, 42) are connected to each other by the curved metal piece (60), and the indicator light (51) is lit up by an electric current through the spring (54), the indicator light (51), the terminals (52, 53) and the grounding prong (43).

In this conventional circuit breaker, however, a problem arises that the terminal (52) and the grounding prong (43) are engaged with each other in a way of point contact, which means a very small contact area between these engaged parts (52, 43).

The small contact area leads to a high contact resistance, which usually brings about electric sparks and oxidation about the point of contact, and so the circuit breaker has a relatively short life.

Therefore, it is an objective of the invention to provide a circuit breaker to mitigate and/or obviate the aforementioned problems.

SUMMARY OF THE INVENTION

The object of the present invention is to provide a circuit breaker which has a prolonged life.

Other objects, advantages and novel features of the invention will become more apparent from the following detailed description when taken in conjunction with the accompanying drawings.

DETAILED DESCRIPTION OF THE PREFERRED EMBODIMENT

Figure 1:
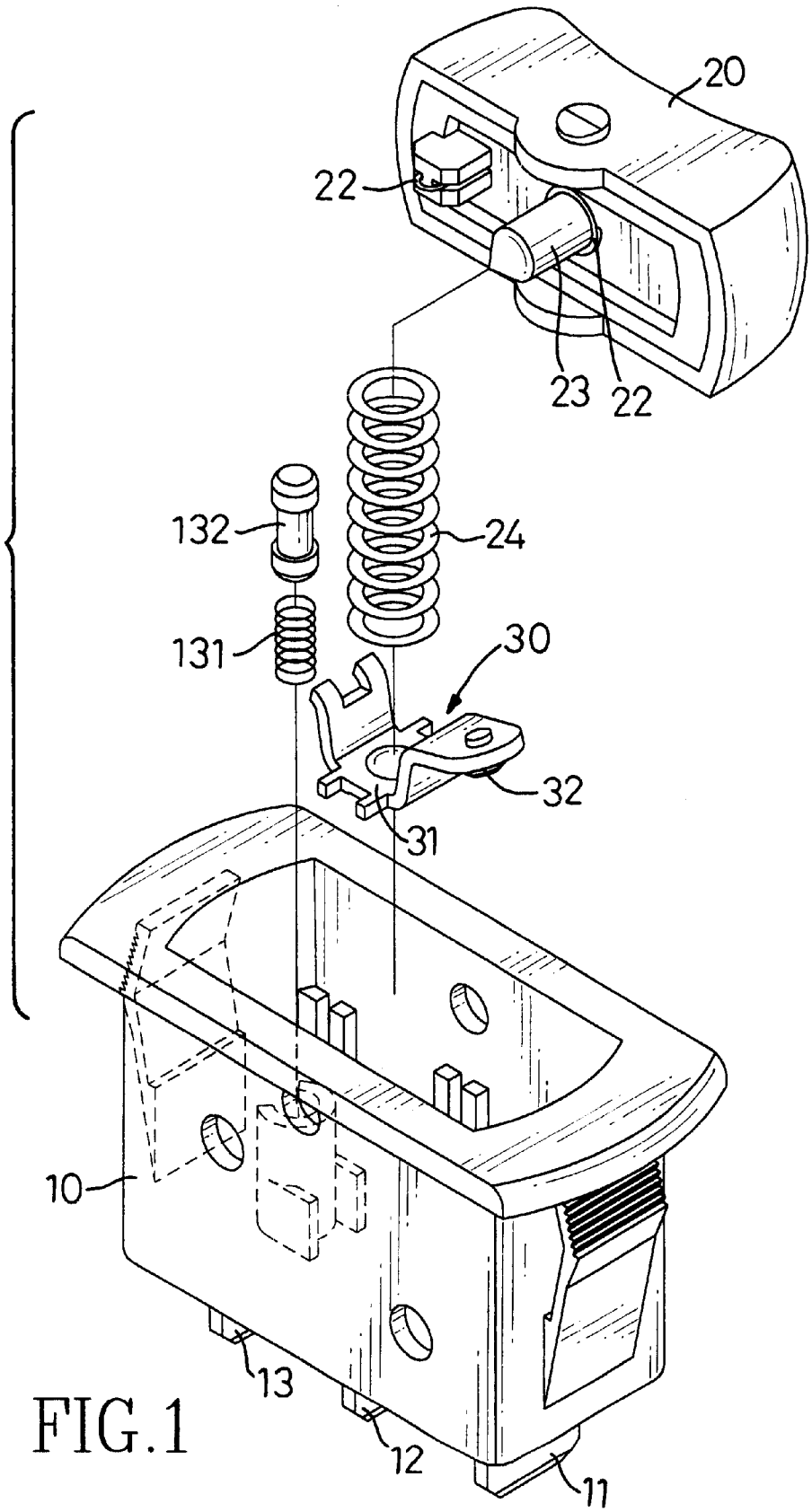
FIG. 1 is an exploded perspective view of a preferred embodiment of a circuit breaker in accordance with the present invention.

Referring to FIG. 1, a circuit breaker in accordance with the present invention includes a shell (10) having an open top and a closed bottom. A hollow button (20) is pivotally connected to the shell (10) at the open top, such as by a pin.

Figure 2:
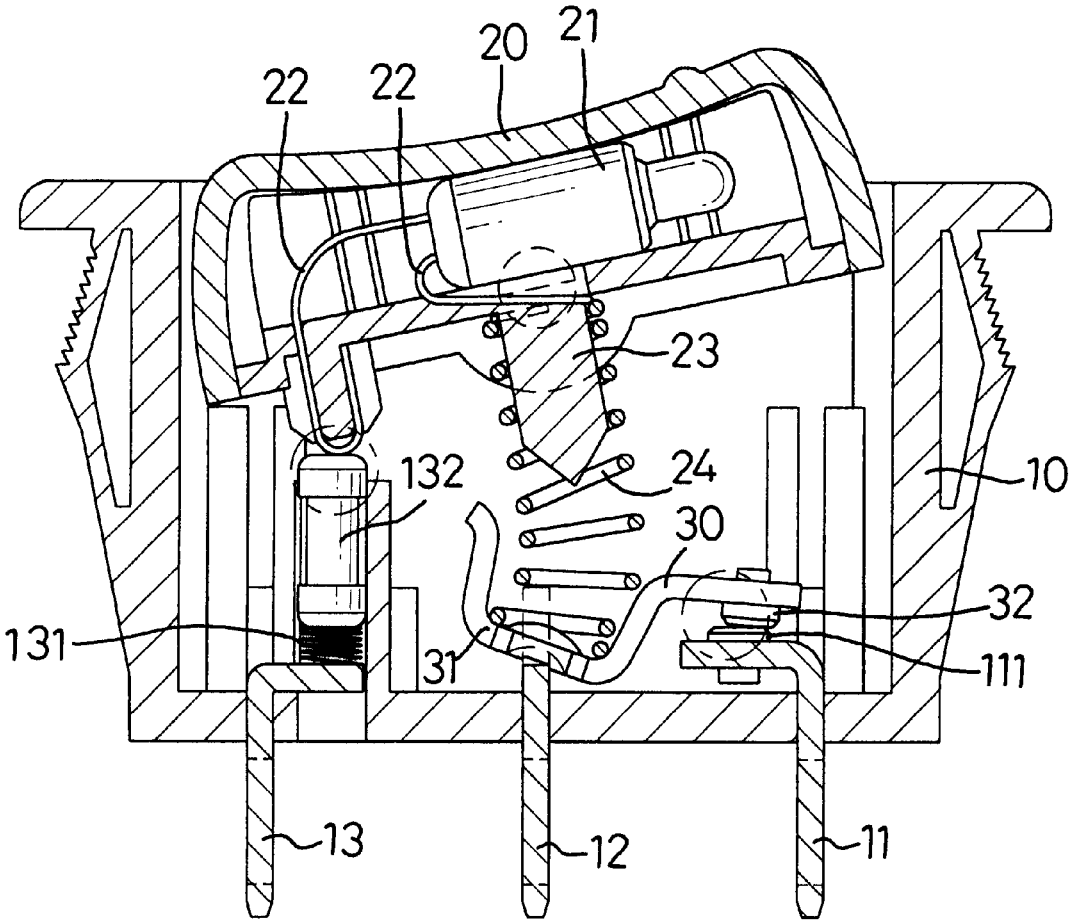
FIG. 2 is a cross-sectional view showing the circuit breaker of FIG. 1 in its closed position.
Figure 3:
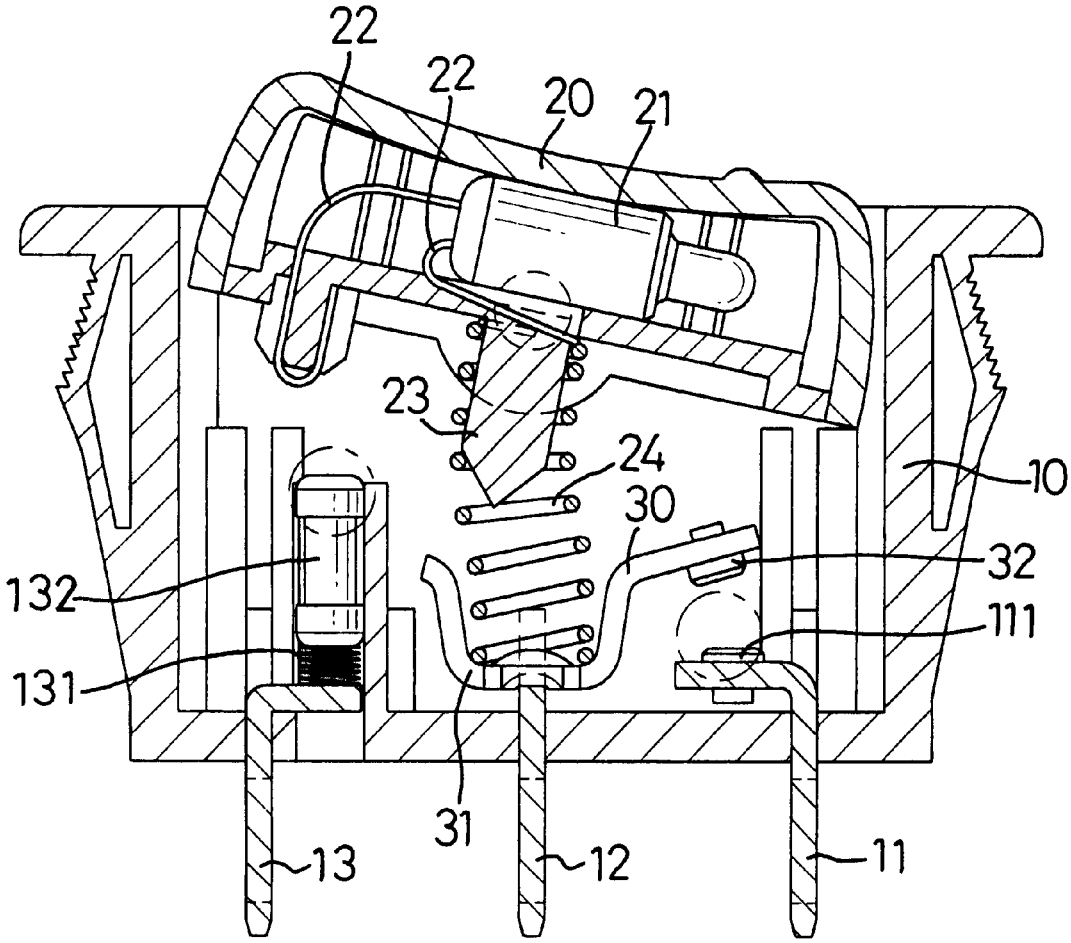
FIG. 3 is a cross-sectional view showing the circuit breaker of FIG. 1 in its open position.
Figure 4:
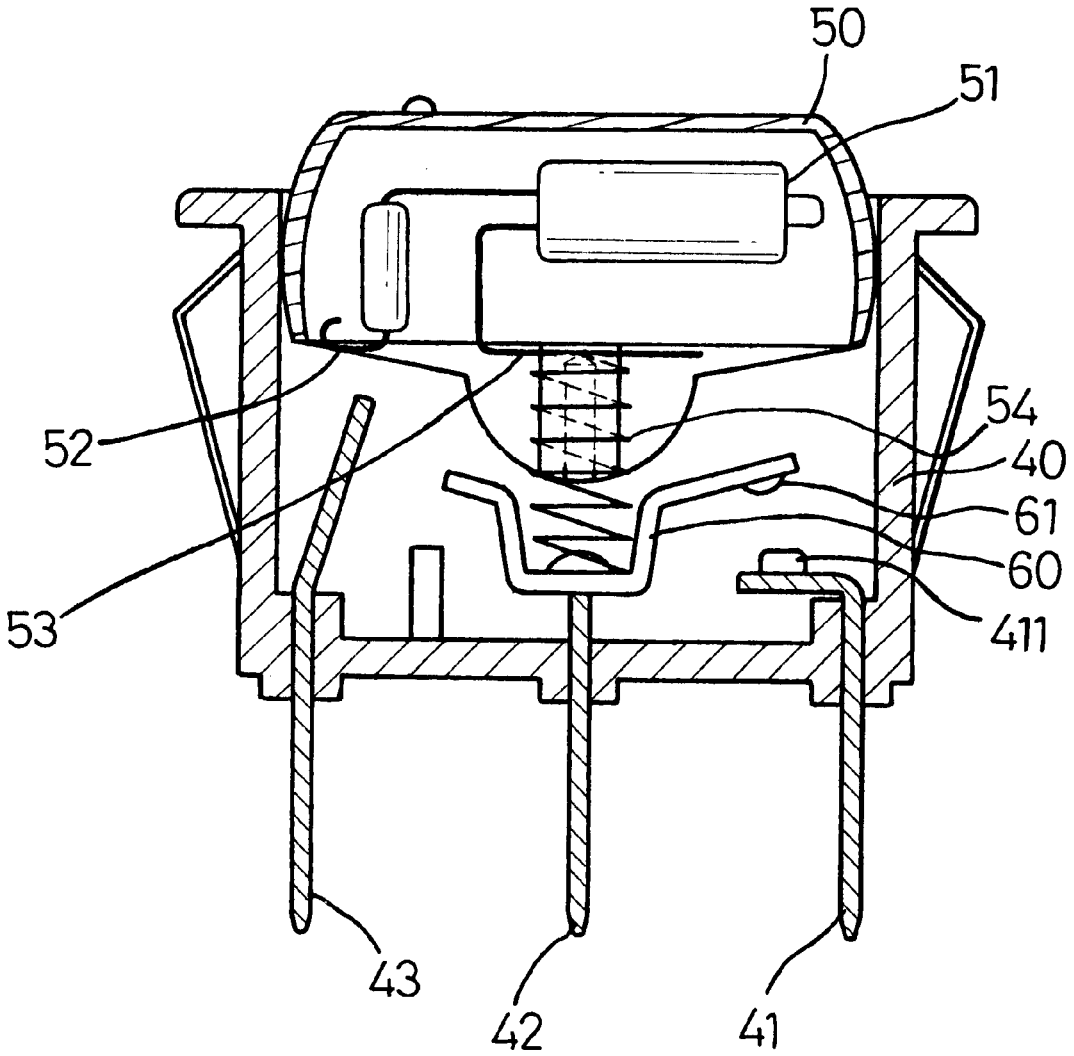
FIG.4 PRIOR ART
FIG. 4 is a cross-sectional view of a conventional circuit breaker.

The button (20) is pivotal relative to the shell (10) between a first angular position, as shown in FIG. 2, and a second angular position, as shown in FIG. 3.

Referring to FIG. 2, the hollow button (20) has an indicator light (21) received therein, and a central tab (23) extending towards the closed bottom of the shell (10).

The circuit breaker further includes a first blade (11), a second blade (12) and a grounding prong (13), all extending from the interior to the exterior of the shell (10) through its closed bottom, with the second blade (12) located between the first blade (11) and the ground prong (13) and substantially aligned with the tab (23) of the button (20).

The first blade (11) and the ground prong (13) each have a bent inner end, except that the first blade (11) is additionally provided with a first contact (111) on its inner end.

Housed in the shell (10) is a curved metal piece (30) that is electrically and pivotally connected to an inner end of the second blade (12). Preferably, the curved metal piece (30) has a U-shaped portion (31), terminating in an elongated end formed with a second contact (32) of platinum.

The curved metal piece (30) is pivotal relative to the shell (10) but is normally in its first angular position, in which the second contact (32) of the curved metal piece (30) is brought into contact with the first contact (111) of the first blade (11), as clearly shown in FIG. 2.

Between the hollow button (20) and the curved metal piece (30) there is a helical spring (24) that has a first end mounted round the tab (23) and a second end held in the U-shaped portion (31). The helical spring (24), slightly curved rightward, is compressed in such a way that the button (20) and the curved metal piece (30) are both retained in their first positions.

In the inventive circuit breaker, however, a resistor (132) is additionally held in the shell (11) preferably within a compartment (not numbered) near the grounding prong (13). The resistor (132) is electrically connected to the grounding prong (13), by way of a compression spring (131) that is compressed between the resistor (132) and the bent inner end of the grounding prong (13).

In addition, the indicator light (21) received in the hollow button (20) has two terminals (22): one is electrically connected with the helical spring (24), and the other is engagable with the resistor (132) when the button (20) is in its first angular position. In this way, the indicator light (21) is normally lit up, indicating the correct connection between the blades (11, 12).

Referring to FIG. 3, the curved metal piece (30) is heated and warped if an electric overcurrent goes through it as well as the blades (11, 12). The warped piece (30) will reverse the curvature of the spring (24) which then shifts the button (20) and the curved metal piece (30) to their second angular positions, in which the second contact (32) of the curved metal piece (30) is away from the first contact (111) of the first blade (11), as clearly shown in FIG. 3.

As a result, the blades (11, 12) are disconnected and the electric current is stopped from flowing, thereby avoiding damage to the appliance which causes the overcurrent.

From the above description, it is noted that the invention has the following advantages:

1. enlarged contact area:

Because the resistor (132) is provided for the engagement with one terminal (22) of the indicator light (21), the contact area between them is enlarged.

2. prolonged life:

Because of the enlarged contact area, the contact resistance at the point and hence oxidation about the point are reduced, and so the life of the circuit breaker is prolonged.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A circuit breaker comprising:

a shell (10) having an open top and a closed bottom;

a hollow button (20) pivotally connected to said shell (10) at said open top, said button (20) being formed with a central tab (23) extending towards said closed bottom of said shell (10);

said button (20) being pivotal relative to said shell (10) between a first angular position and a second angular position;

a first blade (11), a second blade (12) and a grounding prong (13) all extending from the interior to the exterior of said shell (10) through said closed bottom, said second blade (12) being located between said first blade (11) and said ground prong (13), said second blade (12) being substantially aligned with said tab (23) of said hollow button (20);

a curved metal piece (30) housed in said shell (10) and electrically and pivotally connected to an inner end of said second blade (12);

said curved metal piece (30) being pivotal relative to said shell (10) between a first angular position, in which said curved metal piece (30) is in contact with said first blade (11), and a second angular position, in which said curved metal piece (30) is away from said first blade (11);

a helical spring (24) mounted around said tab (23) and compressed between said hollow button (20) and said curved metal piece (30);

a resistor (132) held in said shell (11) and electrically connected to said grounding prong (13);

an indicator light (21) received in said hollow button (20) and having a first terminal (22) and a second terminal (22);

said first terminal (22) of said indicator light (21) being electrically connected with said helical spring (24), said second terminal (22) of said indicator light (21) being engagable with said resistor (132) when said hollow button (20) is in its first angular position; and wherein said helical spring (24) is selected so that said hollow button (20) and said curved metal piece (30) may be shifted from said first angular positions to said second angular positions when said curved metal piece (30) is warped by heat produced by overcurrent through said blades (11, 12).

2. The circuit breaker as claimed in claim 1 further including a compression spring (131) compressed between said resistor (132) and said ground prong (13), thereby electrically connecting said resistor (132) to said prong (13).

3. The circuit breaker as claimed in claim 2, wherein said curved metal piece (30) has a U-shaped portion (31) formed at said inner end of said second blade (12), and wherein said helical spring (24) has a first end mounted around said tab (23) of said hollow button (20) and a second end held in said U-shaped portion (31) of said curved metal piece (30).

* * * * *